US007393206B2

(12) United States Patent
Lin

(10) Patent No.: US 7,393,206 B2
(45) Date of Patent: Jul. 1, 2008

(54) HEAT EXCHANGE FURNACE WITH SERPENTINE GAS FLOW PATH DISPOSED WITHIN HEAT EXCHANGE SPACE

(75) Inventor: Jung-Lang Lin, Wu Feng Hsiang (TW)

(73) Assignee: Suncue Company Ltd. (TW)

( * ) Notice: Subject to any disclaimer, the term of this patent is extended or adjusted under 35 U.S.C. 154(b) by 52 days.

(21) Appl. No.: 11/503,249

(22) Filed: Aug. 14, 2006

(65) Prior Publication Data

US 2008/0070179 A1 Mar. 20, 2008

(51) Int. Cl.
*F28D 7/10* (2006.01)

(52) U.S. Cl. ..... 432/219; 432/223; 126/99 A; 165/157

(58) Field of Classification Search ..... 432/164, 432/165, 178, 185, 194, 209, 212, 217, 219, 432/223; 126/110 R, 99 A, 99 C, 99 D, 77, 126/68, 69, 70, 71, 72, 83; 165/157, 159
See application file for complete search history.

(56) References Cited

U.S. PATENT DOCUMENTS 2,357,831 A * 9/1944 Judy ..... 126/99 R
3,796,547 A * 3/1974 Muenger ..... 422/200
4,093,022 A * 6/1978 Polyak, Jr. ..... 165/299
4,319,557 A * 3/1982 Sietmann et al. ..... 126/110 R
4,449,510 A 5/1984 Sukup
4,579,102 A * 4/1986 Sukup ..... 126/99 A
4,646,820 A * 3/1987 Brightbill et al. ..... 165/145
5,205,276 A * 4/1993 Aronov et al. ..... 126/109
2004/0031600 A1* 2/2004 Kontu ..... 165/167
2007/0169924 A1* 7/2007 Bussonnet ..... 165/157

* cited by examiner

*Primary Examiner*—Gregory A Wilson
(74) *Attorney, Agent, or Firm*—Davidson Berquist Jackson & Gowdey LLP

(57) ABSTRACT

A heat exchange furnace includes a surrounding wall disposed around a combustion furnace unit so as to define an annular heat exchange space therebetween. Upright buffer plates divide the heat exchange space into a plurality of air chambers communicated with each other. Upper and lower gas-guiding members are connected respectively and fixedly to upper and lower ends of the surrounding wall. Conduit sets are disposed within the heat exchange space, and cooperate with the upper and lower gas-guiding members so as to constitute cooperatively at least one serpentine gas flow path disposed within the heat exchange space.

7 Claims, 6 Drawing Sheets

HEAT EXCHANGE FURNACE WITH SERPENTINE GAS FLOW PATH DISPOSED WITHIN HEAT EXCHANGE SPACE

BACKGROUND OF THE INVENTION

1. Field of the Invention

This invention relates to a furnace, more particularly to a heat exchange furnace that include at least one serpentine gas flow path disposed within a heat exchange space.

2. Description of the Related Art

Referring to FIG. 1, a biomass heat exchange furnace 1 disclosed in U.S. Pat. No. 4,449,510 is used to burn biomass to thereby generate high-temperature combustion gases. Ambient or fresh air is forced into the heat exchange furnace for heat exchange contact with the combustion gases. As such, the temperature of the combustion gases is reduced prior to exhaust from the heat exchange furnace. On the other hand, the ambient air is heated to form hot air that may serve as a heat source for various utilizations.

The heat exchange furnace 1 includes a heat exchange space 11 defined by a surrounding wall 12, and a plurality of conduits 13 disposed within the heat exchange space 11. A gas entrance chamber 14, an upper gas transfer chamber 15, and a gas exit chamber 16 are disposed above the heat exchange space 11. Two lower gas transfer chambers 17, 18 are disposed under the heat exchange space 11. The combustion gases flow through the conduits 13 and the chambers 14, 15, 16, 17, 18.

The aforesaid conventional heat exchange furnace 1 has the following disadvantages:

(1) The speed of air flowing through the heat exchange space 11 is rapid, thereby reducing the heat exchange efficiency of the heat exchange furnace 1.

(1) Since the upper gas transfer chamber 15 has a large volume, and since only one of the same is provided in the heat exchange furnace 1, the heat exchange efficiency of the heat exchange furnace 1 is further reduced.

SUMMARY OF THE INVENTION

The object of this invention is to provide a heat exchange furnace that has an improved heat exchange efficiency.

According to this invention, a heat exchange furnace includes a surrounding wall disposed around a combustion furnace unit so as to define an annular heat exchange space therebetween. Upright buffer plates divide the heat exchange space into a plurality of air chambers communicated with each other. Upper and lower gas-guiding members are connected respectively and fixedly to upper and lower ends of the surrounding wall. Conduit sets are disposed within the heat exchange space. The upper and lower gas-guiding members cooperate with the conduit sets so as to constitute cooperatively at least one serpentine gas flow path disposed within the heat exchange space.

Due to the presence of the buffer plates disposed in the heat exchange space, the time required for air to flow through the heat exchange space is extended, thereby improving the heat exchange efficiency of the heat exchange furnace.

Furthermore, the upper guiding member may be designed to include a plurality of upper gas transfer chambers so as to form a plurality of serpentine gas flow paths. As such, the upper gas transfer chambers are compact. This allows combustion gases to pass rapidly through the upper gas transfer chambers, and to have a large area of heat exchange contact with the air flowing through the heat exchange space, thereby further improving the heat exchange efficiency of the heat exchange furnace.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
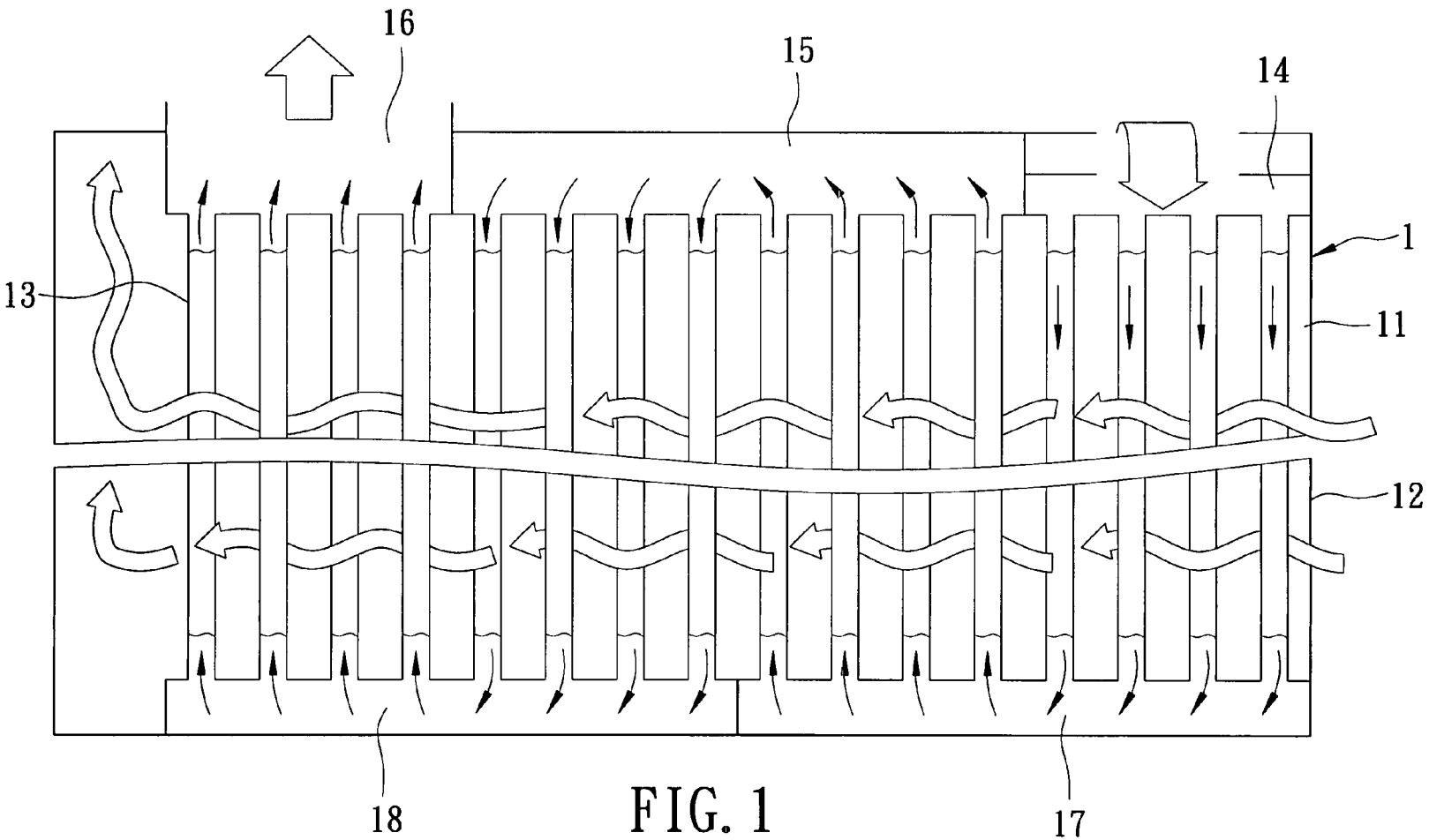
FIG. 1 PRIOR ART
FIG. 1 is an unfolded view of a biomass heat exchange furnace disclosed in U.S. Pat. No. 4,449,510.
Figure 2:
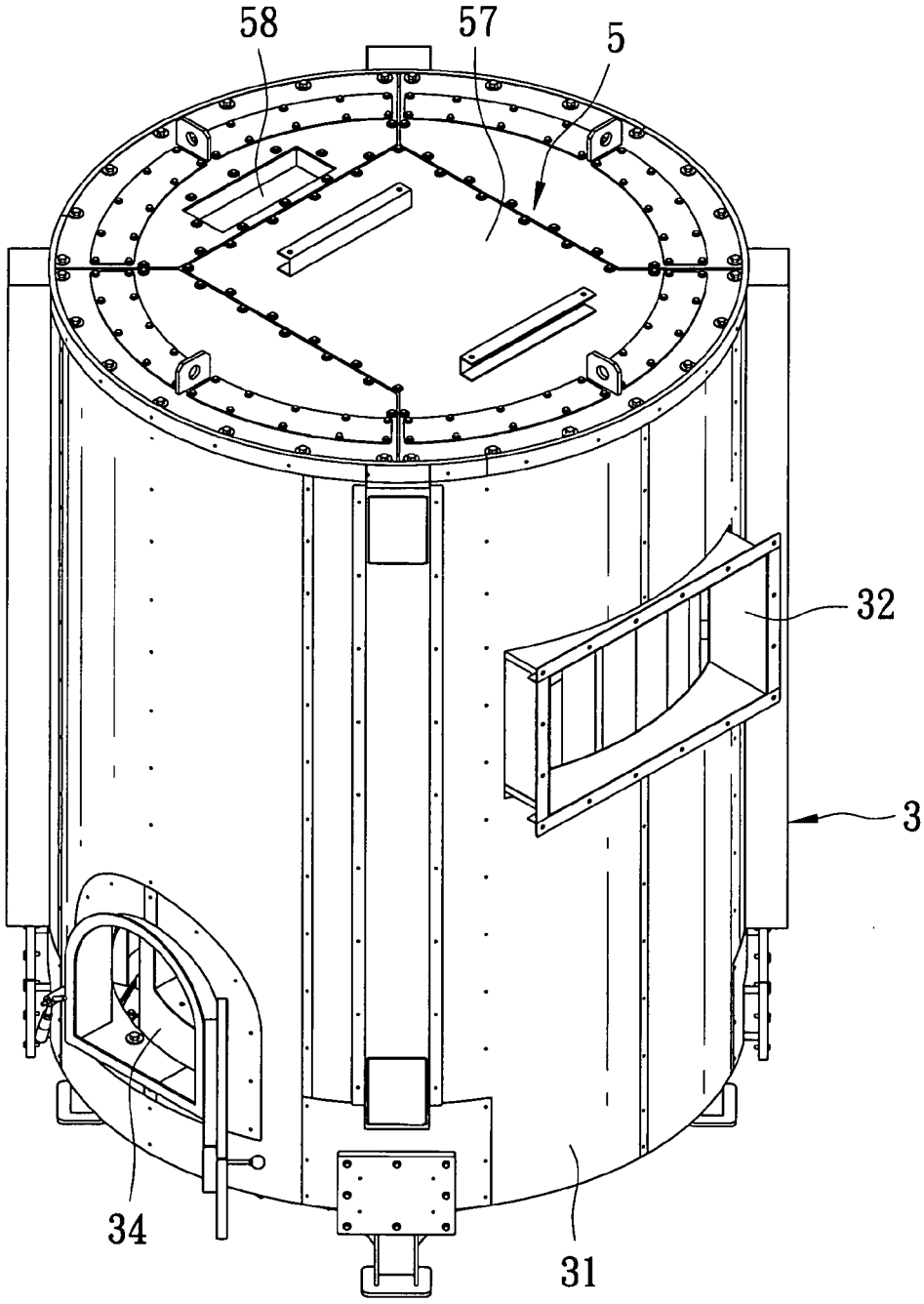
FIG. 2 is a perspective view of the preferred embodiment of a heat exchange furnace according to this invention.
Figure 3:
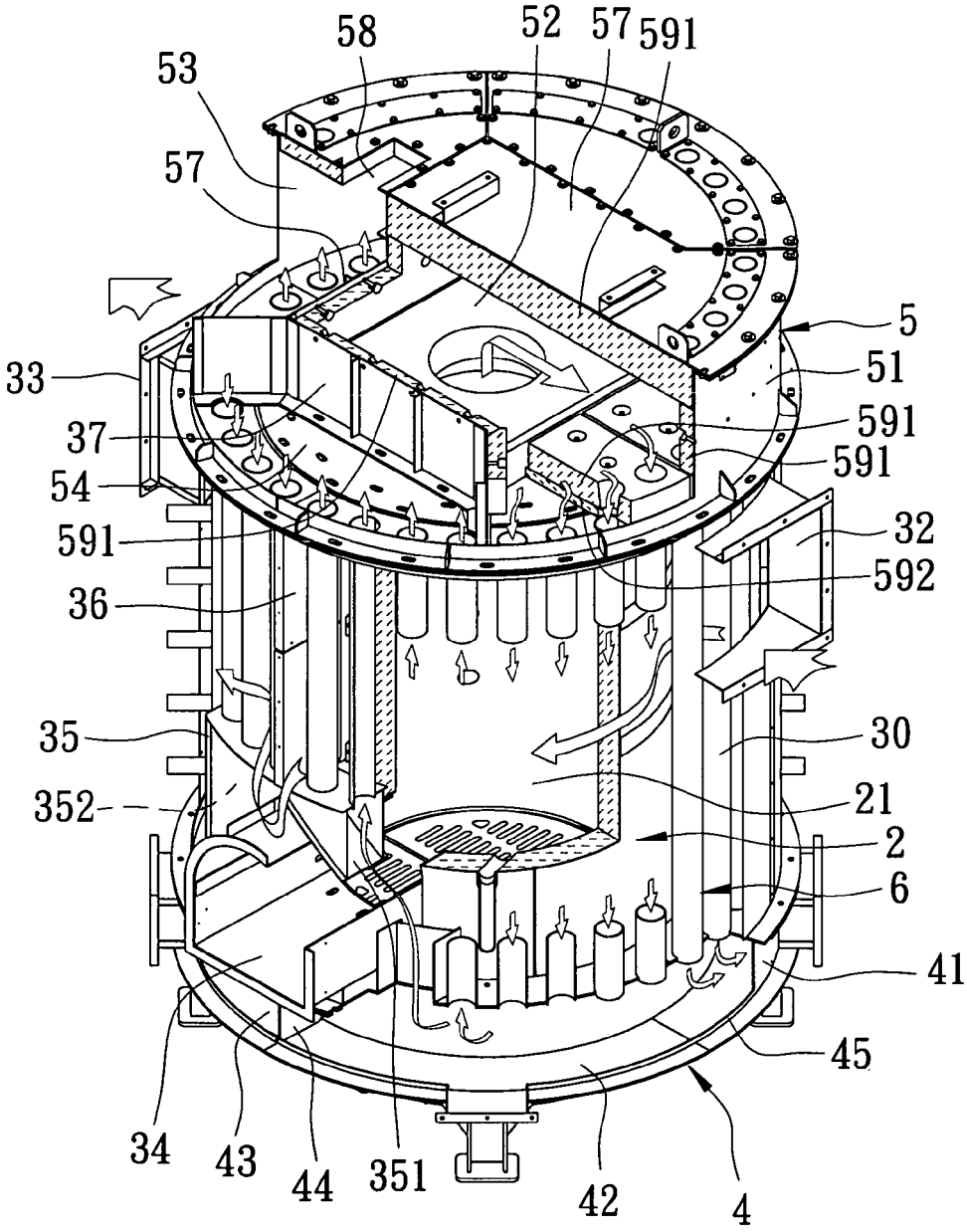
FIG. 3 is a fragmentary, partly sectional perspective view of the preferred embodiment, illustrating a fireproofing layer and a thermal insulating layer.
Figure 4:
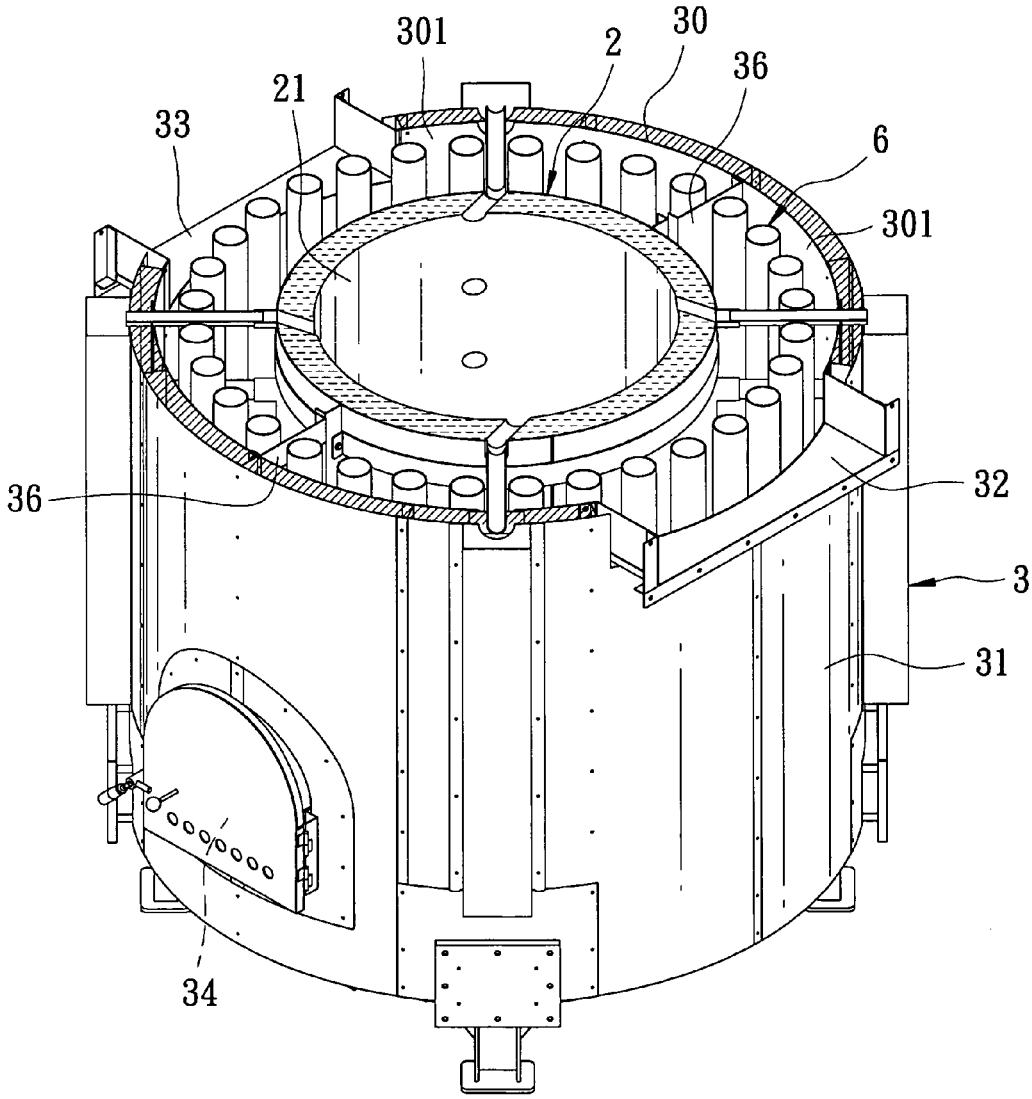
FIG. 4 is a fragmentary, partly sectional perspective view of the preferred embodiment, illustrating how an annular heat exchange space is divided into two air chambers by two buffer plates.

Referring to FIGS. 2, 3, and 4, the preferred embodiment of a heat exchange furnace according to this invention includes a combustion furnace unit 2, a thermal insulating device 3, a lower guiding member 4, an upper guiding member 5, and a conduit assembly 6.

The combustion furnace unit 2 has a combustion chamber 21 adapted to burn fuel (such as corn stalks, cobs, etc.) so that combustion gases and heat are generated therein.

The thermal insulating device 3 includes a surrounding wall 31, a protective shield 35, and two aligned upright buffer plates 36. The surrounding wall 31 is disposed around the combustion furnace unit 2 so as to define an annular heat exchange space 30 therebetween, and is formed with an air inlet unit 32, an air outlet unit 33, and a fuel inlet unit 34 for permitting fuel to be fed into the combustion furnace unit 2 therethrough. Each of the air inlet unit 32 and the air outlet unit 33 is communicated with the heat exchange space 30 and the ambient surroundings. The fuel inlet unit 34 is configured as a tube extending through the heat exchange space 30, and is communicated with the combustion furnace unit 2. The protective shield 35 is disposed fixedly in the heat exchange space 30, and surrounds the fuel inlet unit 34. The protective shield 35 has two insulated first and second compartments 351, 352. The buffer plates 36 are disposed in an upper portion of the heat exchange space 30, and between the air inlet unit 32 and the air outlet unit 33. The buffer plates 36 are aligned along a horizontal direction for dividing the heat exchange space 30 into two air chambers 301 communicated with each other via spaces disposed under the buffer plates 36. Due to the presence of the buffer plates 36, the speed of air flowing from the air inlet unit 32 to the air outlet unit 33 through the heat exchange space 30 is retarded. Thus, the time required for the combustion gases to pass through the heat exchange space 30 is extended. This improves the heat exchange efficiency of the heat exchange furnace.

The lower gas-guiding member 4 is connected fixedly to a lower end of the surrounding wall 31 for sealing a lower end of the heat exchange space 30, and is formed with first and second lower gas transfer chambers 42, 43 that are defined by two partitions 44 and a bottom plate 45 and that are communicated respectively with the first and second compartments 351, 352.

Figure 5:
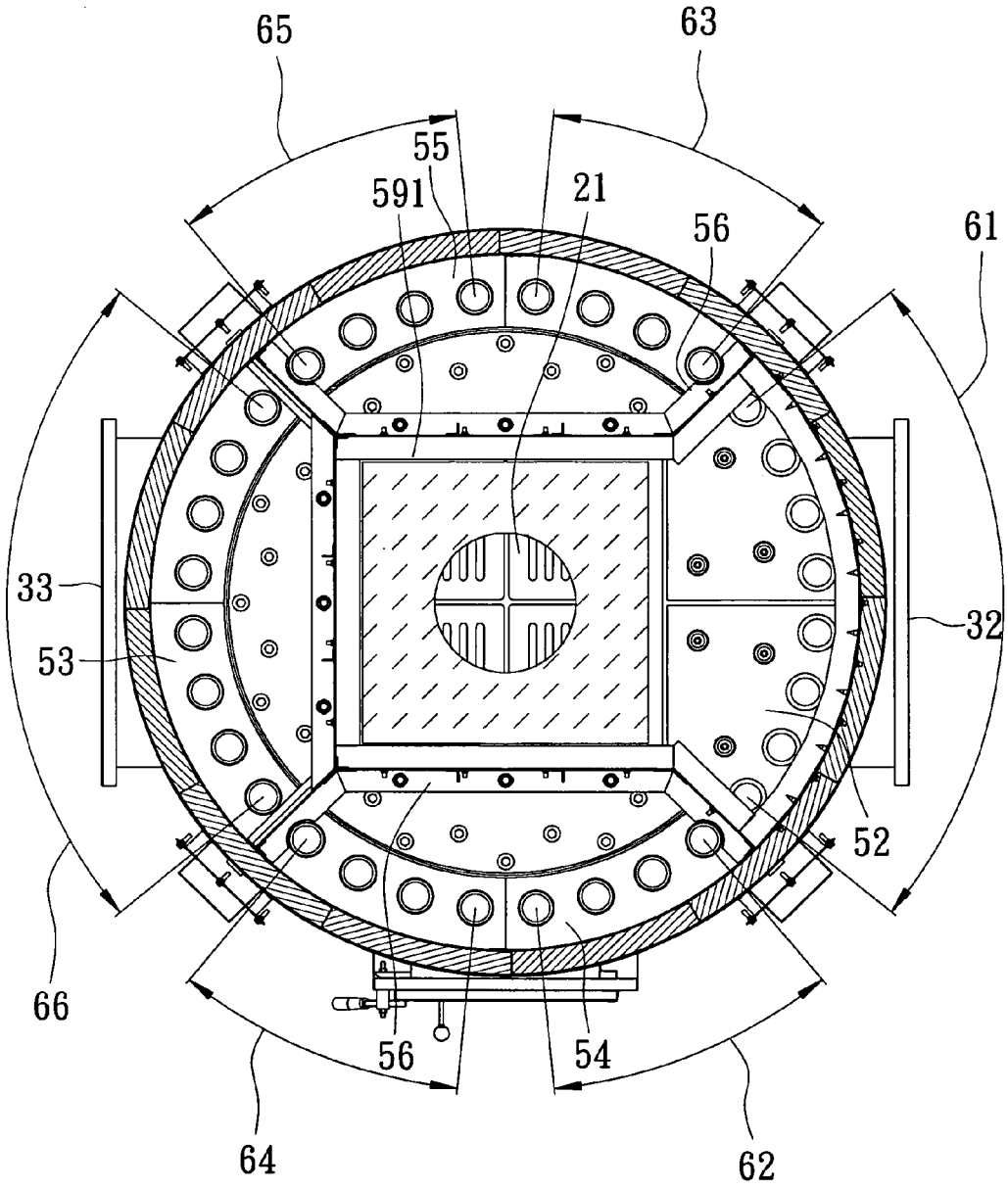
FIG. 5 is a sectional view of the preferred embodiment, illustrating positions of a plurality of conduits relative to a gas entrance chamber, a gas exit chamber, and two upper gas transfer chambers in an upper guiding member.
Figure 6:
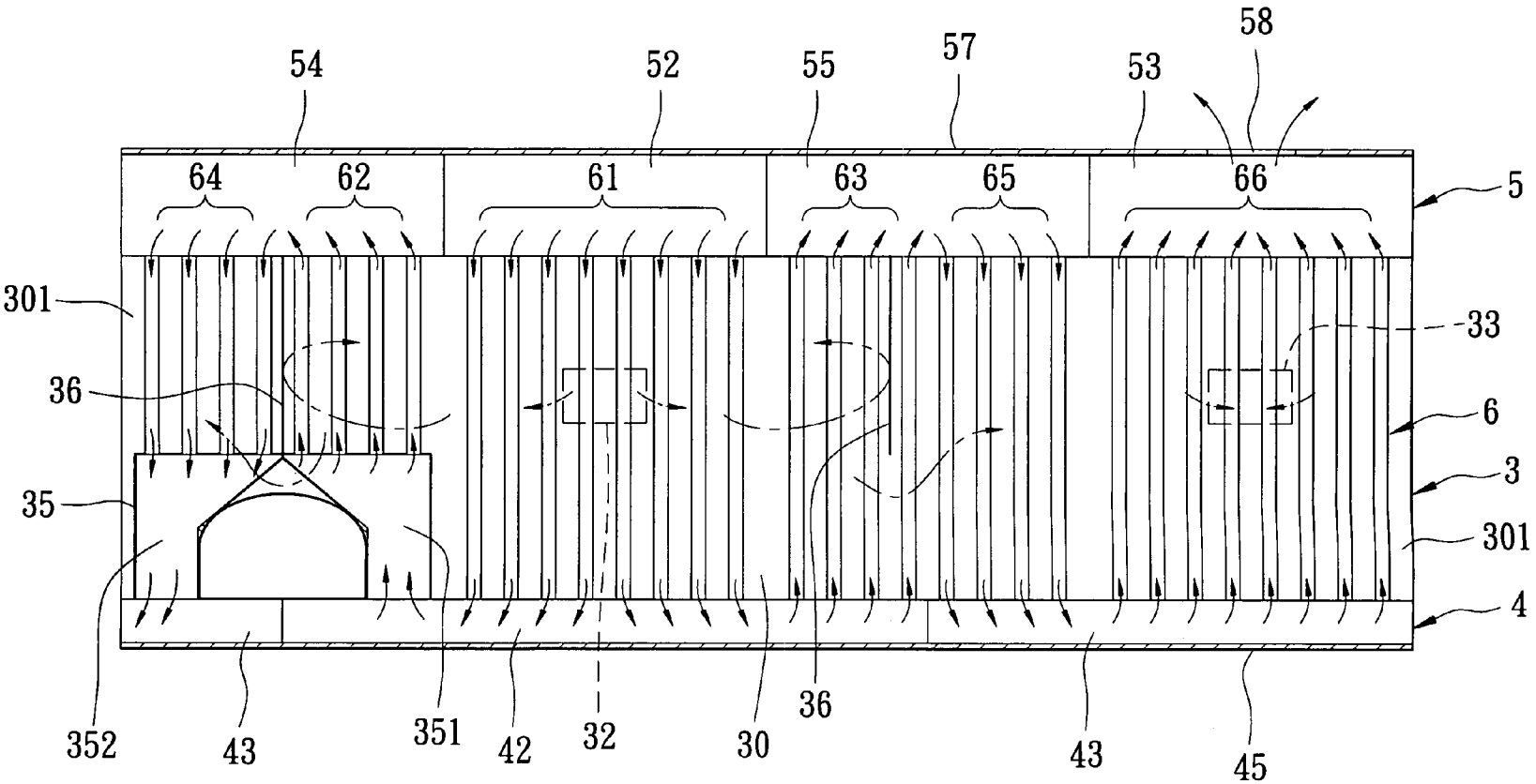
FIG. 6 is an unfolded view of the preferred embodiment, illustrating two serpentine gas flow paths.

With further reference to FIGS. 5 and 6, the upper gas-guiding member 5 is connected fixedly to an upper end of the surrounding wall 31 for sealing an upper end of the heat exchange space 30. The upper gas-guiding member 5 has a gas entrance chamber 52, a gas exit chamber 53, and first and second upper gas transfer chambers 54, 55, which are defined by a plurality of partitions 56 and a top plate 57. The gas entrance chamber 52 is communicated with the combustion furnace unit 2. The first and second upper gas transfer chambers 54, 55 are disposed between the gas entrance chamber 52 and the gas exit chamber 53. The top plate 57 is formed with a gas outlet 58 communicated with the gas exit chamber 53 and the ambient surroundings. A fireproofing layer 591 is disposed on surfaces of the partitions 56, the top plate 57, and the thermal insulating device 3, which define the gas entrance chamber 52. A thermal insulating layer 592 is sandwiched between the fireproofing layer 591 and the thermal insulating device 3.

The conduit assembly 6 includes a first conduit set consisting of eight first conduits 61, a second conduit set including four second conduits 62, a third conduit set consisting of four third conduits 63, a fourth conduit set consisting of four fourth conduits 64, a fifth conduit set consisting of four fifth conduits 65, and a sixth conduit set consisting of eight sixth conduits 66. The first, second, third, fourth, fifth, and sixth conduits 61, 62, 63, 64, 65, 66 are disposed within the heat exchange space 30 and around the combustion furnace unit 2. The second and fourth conduits 62, 64 have lower ends connected fixedly to an upper end of the protective shield 35. In particular, the second conduits 62 have lower ends communicated with the first compartment 351 in the protective shield 35, and the fourth conduits 64 have lower ends communicated with the second compartment 352 in the protective shield 35.

Four of the first conduits 61 nearer to the second conduits 62, the second conduits 62, the fourth conduits 64, and four of the sixth conduits 66 nearer to the fourth conduits 64 constitute a first conduit unit. The other four of the first conduits 61, the third conduits 63, the fifth conduits 65, and the other four of the sixth conduits 66 constitute a second conduit unit. Each of the first and second conduit units cooperates with the upper and lower guiding members 5,4 so as to constitute a serpentine gas flow path.

The gas entrance chamber 52 is communicated with the combustion chamber 21 in the combustion furnace unit 2 and upper ends of the first conduits 61. The first upper gas transfer chamber 54 is communicated with upper ends of the second and fourth conduits 62, 64. The second upper gas transfer chamber 55 is communicated with upper ends of the third and fifth conduits 63, 65. The gas exit chamber 53 is communicated with upper ends of the sixth conduits 66 and the gas outlet unit 58.

The first lower gas transfer chamber 42 is communicated with lower ends of the first, second, and third conduits 61, 62, 63. The second lower gas transfer chamber 43 is communicated with lower ends of the fourth, fifth, and sixth conduits 64, 65, 66.

When fuel is burnt within the combustion chamber 21 in the combustion furnace module 2, ambient or fresh air flows into the combustion chamber 21. A portion of the combustion gases flows along the first serpentine gas flow path defined by the gas entrance chamber 52, four of the first conduits 61, the first lower gas transfer chamber 42, the second conduits 62, the first upper gas transfer chamber 54, the fourth conduits 64, the second lower gas transfer chamber 43, four of the sixth conduits 66, and the gas exit chamber 53. The remaining portion of the combustion gases flows along the second serpentine gas flow path defined by the gas entrance chamber 52, the other four of the first conduits 61, the first lower gas transfer chamber 42, the third conduits 63, the second upper gas transfer chamber 55, the fifth conduits 65, the second lower gas transfer chamber 43, the other four of the sixth conduits 66, and the gas exit chamber 53.

When combustion gases flow within the first, second, third, fourth, fifth, and sixth conduits 61, 62, 63, 64, 65, 66, cold air flows into the heat exchange space 30 through the air inlet unit 32 for heat exchange contact therewith. Hence, the temperature of the combustion gases is reduced prior to exhaust from the heat exchange furnace. On the other hand, the air in the heat exchange space 30 is heated to thereby form hot air. The hot air is removed from the heat exchange furnace through the air outlet unit 33 into piping (not shown), and may serve as a heat source for various utilizations.

Since the upper guiding member 5 has two upper gas transfer chambers (i.e., the first and second upper gas transfer chambers 54, 55), two serpentine gas flow paths are formed, and the first and second upper gas transfer chambers 54, 55 are compact. This allows combustion gases to pass rapidly through the first and second upper gas transfer chambers 54, 55, and to have a large area of heat exchange contact with the air flowing through the heat exchange space 30, thereby further improving the heat exchange efficiency of the heat exchange furnace.

With this invention thus explained, it is apparent that numerous modifications and variations can be made without departing the scope and spirit of this invention. It is therefore intended that this invention be limited only as indicated by the appended claims.

I claim:

1. A heat exchange furnace comprising:

a combustion furnace unit adapted to burn fuel such that combustion gases are generated therein;

a thermal insulating device including a surrounding wall disposed around said combustion furnace unit so as to define an annular heat exchange space therebetween, said surrounding wall being formed with an air inlet unit and an air outlet unit that are communicated with the heat exchange space and the ambient surroundings, and a plurality of upright buffer plates disposed between said surrounding wall and said combustion furnace unit for dividing said heat exchange space into a plurality of air chambers communicated with each other;

a lower gas-guiding member connected fixedly to a lower end of said surrounding wall for sealing a lower end of said heat exchange space, said lower gas-guiding member being formed with a plurality of lower gas transfer chambers;

an upper gas-guiding member connected fixedly to an upper end of said surrounding wall for sealing an upper end of said heat exchange space, said upper gas-guiding member having a gas entrance chamber communicated with said combustion furnace unit, a gas exit chamber, a plurality of upper gas transfer chambers disposed between said gas entrance chamber and said gas exit chamber, and a gas outlet communicated with said gas exit chamber and the ambient surroundings; and a conduit assembly having at least one conduit unit including a plurality of conduit sets disposed within said heat exchange space and around said combustion furnace unit, any two adjacent ones of said conduit sets being communicated with each other by a respective one of said lower gas transfer chambers in said lower gas-guiding member and said gas entrance chamber, said gas exit chamber, and said upper gas transfer chambers in said upper gas-guiding member in such a manner that said upper and lower gas-guiding members as well as said conduit unit constitute cooperatively a serpentine gas flow path disposed within said heat exchange space.

2. The heat exchange furnace as claimed in claim 1, wherein said conduit assembly has two said conduit units cooperating with said upper and lower gas-guiding members so as to constitute cooperatively two said serpentine gas flow paths.

3. The heat exchange furnace as claimed in claim 1, wherein said buffer plates are disposed in an upper portion of said heat exchange space, and between said air inlet unit and said air outlet unit in said surrounding wall, the buffer plates being aligned along a horizontal direction.

4. The heat exchange furnace as claimed in claim 3, wherein said upper gas-guiding member further has a fireproofing layer disposed on surfaces of said partitions and said thermal insulating device, which define said gas entrance chamber.

5. The heat exchange furnace as claimed in claim 4, wherein said upper gas-guiding member further has a thermal insulating layer sandwiched between said fireproofing layer and said thermal insulating device.

6. The heat exchange furnace as claimed in claim 1, wherein said surrounding wall of said thermal insulating device is further formed with a fuel inlet unit that is communicated with said combustion furnace unit and that is adapted to permit fuel to be fed into said combustion furnace unit therethrough.

7. The heat exchange furnace as claimed in claim 6, wherein said fuel inlet unit is configured as a tube, and extends through said heat exchange space, said thermal insulating device further including a protective shield disposed fixedly in said heat exchange space and that surrounds said fuel inlet unit, said protective shield having a plurality of insulated compartments which are communicated respectively with said lower gas transfer chambers, said protective shield being connected fixedly to corresponding ones of said conduit sets such that said compartments are communicated respectively with the corresponding ones of said conduit sets.

* * * * *